United States Patent [19]

Anderson

[11] 4,037,658

[45] July 26, 1977

[54] METHOD OF RECOVERING VISCOUS PETROLEUM FROM AN UNDERGROUND FORMATION

[75] Inventor: Donald J. Anderson, Newport Beach, Calif.

[73] Assignee: Chevron Research Company, San Francisco, Calif.

[21] Appl. No.: 627,304

[22] Filed: Oct. 30, 1975

[51] Int. Cl.[2] ..... E21B 43/24

[52] U.S. Cl. ..... 166/272; 166/302

[58] Field of Search ..... 166/272, 302, 303, 57, 166/50; 299/2, 4, 6

[56] References Cited

U.S. PATENT DOCUMENTS

| | | | |
|---|---|---|---|
| 1,634,235 | 6/1927 | Ranney | 299/2 |
| 1,634,236 | 6/1927 | Ranney | 299/2 |
| 2,786,660 | 3/1957 | Alleman | 299/6 |
| 2,980,184 | 4/1961 | Reed | 166/303 |
| 3,024,013 | 3/1962 | Rogers et al. | 166/302 |
| 3,205,012 | 9/1965 | Dancy | 299/2 |
| 3,338,306 | 8/1967 | Cook | 166/302 |
| 3,386,508 | 6/1968 | Bielstein et al. | 166/272 |
| 3,881,551 | 5/1975 | Terry et al. | 166/272 |

*Primary Examiner*—Stephen J. Novosad
*Assistant Examiner*—George A. Suchfield
*Attorney, Agent, or Firm*—R. L. Freeland, Jr.; Edward J. Keeling

[57] ABSTRACT

Recovery of viscous petroleum such as from tar sands is assisted using a controlled flow of hot fluid in a flow path within the formation but out of direct contact with the viscous petroleum; thus a solid-wall, hollow tubular member in the formation is used for conducting hot fluid to reduce the viscosity of the petroleum to develop a potential passage in the formation outside the tubular member into which a drive fluid is injected to promote movement of the petroleum to a production position.

14 Claims, 8 Drawing Figures

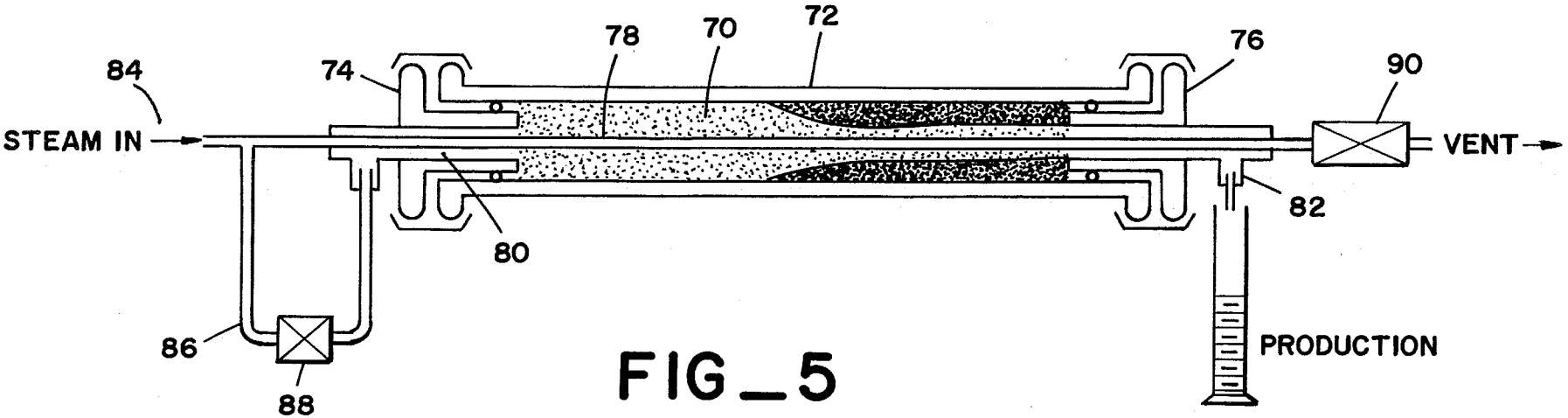
FIG_5
RESIDUAL PETROLEUM WT %
| CORE POSITION | | PLANE A | B | C | D | E | F |
|---|---|---|---|---|---|---|---|
| LEFT SIDE | 1 | 3.8 | 5.5 | 5.9 | 6.5 | 8.2 | 7.2 |
| | 2 | 3.7 | 4.4 | 5.4 | 4.3 | 7.3 | 5.7 |
| | 3 | 3.9 | 4.2 | 5.2 | 5.7 | 4.6 | 7.9 |
| CENTER LINE | 4 | 3.7 | 4.4 | 5.2 | 4.9 | 8.8 | 9.0 |
| | 5 | 3.7 | 4.8 | 3.7 | 4.3 | 7.3 | 7.1 |
| | 6 | 3.7 | 3.9 | 4.1 | 4.2 | 6.7 | 5.4 |
| | 7 | 3.8 | 4.7 | 4.0 | 5.0 | 4.5 | 4.9 |
| RIGHT SIDE | 8 | 4.2 | 5.2 | 6.0 | 6.4 | 10.9 | 9.5 |
| | 9 | 3.8 | 4.4 | 5.8 | 4.5 | 7.0 | 7.3 |
| | 10 | 3.9 | 4.2 | 5.8 | 4.3 | 6.0 | 6.2 |
| | 11 | 4.1 | 5.1 | 7.1 | 5.4 | 5.2 | 5.8 |
FIG_7
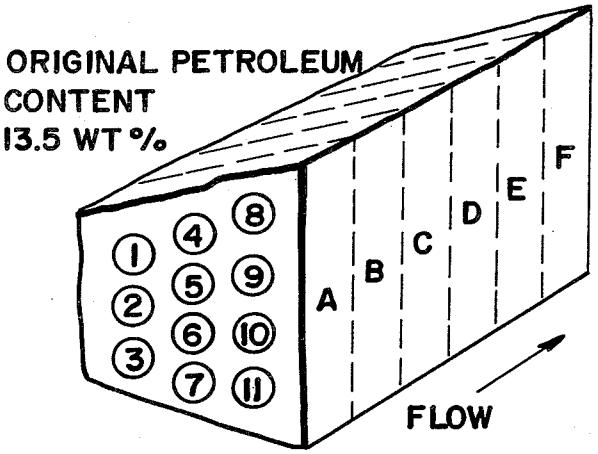
FIG_6

METHOD OF RECOVERING VISCOUS PETROLEUM FROM AN UNDERGROUND FORMATION

CROSS REFERENCE TO RELATED APPLICATIONS

This application is related to application Ser. No. 627,305, filed Oct. 30, 1975, for "Method of Recovering Viscous Petroleum from Tar Sand", application Ser. No. 627,306, filed Oct. 30, 1975, for "Recovering Viscous Petroleum from Thick Tar Sand", application Ser. No. 643,579, filed Dec. 22, 1975, for "System for Recovering Viscous Petroleum from Thick Tar Sand", application Ser. No. 643,580, filed Dec. 22, 1975, for "Method of Recovering Viscous Petroleum from Thick Tar Sand", and application Ser. No. 650,571, filed Jan. 19, 1976, for "Arrangement for Recovering Viscous Petroleum from Thick Tar Sand".

BACKGROUND OF THE INVENTION

This invention relates generally to recovering viscous petroleum from petroleum-containing formations. Throughout the world there are several major deposits of high-viscosity crude petroleum in oil sands not recoverable in their natural state through a well by ordinary production methods. In the United States, the major concentration of such deposits is in Utah, where approximately 26 billion barrels of in-place heavy oil or tar exists. In California, the estimate of in-place heavy oil or viscous crude is 220 million barrels. By far the largest deposits in the world are in the Province of Alberta, Canada, and represent a total in-place resource of almost 1000 billion barrels. The depths range from surface outcroppings to about 2000 feet.

To date, none of these deposits has been produced commercially by an in-situ technology. Only one commercial mining operation exists, and that is in a shallow Athabasca deposit. A second mining project is about 20% completed at the present time. However, there have been many in-situ well-to-well pilots, all of which used some form of thermal recovery after establishing communication between injector and producer. Normally such communication has been established by introducing a pancake fracture. The displacing or drive mechanism has been steam and combustion, such as the project at Gregoire Lake or steam and chemicals such as the early work on Lease 13 of the Athabasca deposit. Another means of developing communication is that proposed for the Peace River project. It is expected to develop well-to-well communication by injecting steam over a period of several years into an acquifier underlying the tar sand deposit at a depth of around 1800 feet. Probably the most active in-situ pilot in the oil sands has been that at Cold Lake. This project uses the huff-and-puff single-well method of steam stimulation and has been producing about 4000 barrels of viscous petroleum per day for several years from about 50 wells. This is probably a semi-commercial process, but whether it is a paying proposition is unknown.

The most difficult problem in any in-situ well-to-well viscous petroleum project is establishing and maintaining communication between injector and producer. In shallow deposits, fracturing to the surface has occurred in a number of pilots so that satisfactory drive pressure could not be maintained. In many cases, problems arise from healing of the fracture when the viscous petroleum that had been mobilized through heat cooled as it moved toward the producer. The cool petroleum is essentially immobile, since its viscosity in the Athabasca deposits, for example, is on the order of 100,000 to 1,000,000 cp at reservoir temperature.

As noted, the major problem of the economic recovery from many formations has been establishing and maintaining communication between an injection position and a recovery position in the viscous oil-containing formation. This is primarily due to the character of the formations, where effective mobility of fluids may be extremely low, and in some cases, such as the Athabasca Tar Sands, virtually nil. Thus, the Athabasca Tar Sands, for example, are strip mined where the overburden is limited. In some tar sands, hydraulical fracturing has been used to establish communication between injectors and producers. This has not met with uniform success. A particularly difficult situation develops in the intermediate overburden depths, which cannot stand fracturing pressure.

Heretofore, many processes have been utilized in attempting to recover viscous petroleum from viscous oil formations of the Athabasca Tar Sands type. The application of heat to such viscous petroleum formations by steam or underground combustion has been attempted. The use of slotted liners positioned in the viscous oil formation as a conduit for hot fluids has also been suggested. However, these methods have not been overly successful because of the difficulty of establishing and maintaining communication between the injector and the producer. Clearly, if one could establish and maintain communication between injector and producer, regardless of the drive fluid or recovery technique employed, it would open up many of these viscous petroleum deposits to a number of potentially successful projects.

BRIEF DESCRIPTION OF THE INVENTION

The present invention is directed to a method of assisting the recovery of viscous petroleum from a petroleum-containing formation and is particularly useful in those formations where communication between an injector and a producer is difficult to establish and maintain. A hole is formed through the petroleum-containing formation and a solid-wall, hollow tubular member is inserted into the hole to provide a continuous, uninterrupted flow path through the formation. A hot fluid is flowed through the interior of the tubular member out of contact with the formation to heat viscous petroleum in the formation outside the tubular member to reduce the viscosity of at least a portion of the petroleum adjacent the outside of the tubular member to provide a potential passage for fluid flow through the formation adjacent the outside of the tubular member. A drive fluid is then injected into the formation through the passage to promote movement of the petroleum for recovery from the formation. In preferred form the hot fluid which is flowed through the tubular member is steam, and the drive fluid used to promote movement of the petroleum is also steam. Depending on certain conditions, the hot fluid and the drive fluid are injected simultaneously. Under other conditions, the hot fluid and the drive fluid are injected intermittently. The injectivity of the drive fluid into the formation is controlled to some extent by adjusting the flow of hot fluid through the tubular member. In this manner, the sweep efficiency of the drive fluid in the formation may be improved.

In one form, the present invention deals with the recovery of viscous petroleum from a tar sand formation of an Athabasca type. An injection shaft and a recovery shaft are formed and extend from the earth's surface through the tar sand formation. A hole is formed through the tar sand formation between the injection shaft and the recovery shaft, and a solid-wall, hollow tubular member is inserted into the hole to provide a continuous, uninterrupted flow path from the injection shaft to the recovery shaft through the tar sand formation. A hot fluid, preferably steam, is flowed through the interior of the tubular member out of contact with the tar sand formation to heat viscous petroleum in the tar sand formation between the injection shaft and the recovery shaft outside the tubular member to reduce the viscosity of at least a portion of the petroleum adjacent the outside of the tubular member to provide a potential passage for fluid flow through the tar sand formation adjacent the outside of the tubular member. A drive fluid is injected from the injection shaft into the formation through the passage to promote flow of petroleum toward the recovery shaft. The petroleum is recovered from the recovery shaft. As noted, the preferred hot fluid is steam, although other fluids may be used. Steam also is preferred for use as a drive fluid. In some situations, other fluids such as gas or water may be useful drive fluids.

OBJECT OF THE INVENTION

The principal object of the present invention is to maximize recovery of viscous petroleum from a petroleum-containing formation wherein communication between an injector position and a producer position is difficult to establish and maintain by utilizing a hot fluid in a physically separated flow path through the formation to assist in establishing and maintaining communication for a drive fluid used to promote movement of the petroleum to the producer. Further objects and advantages of the present invention will become apparent when the description is read in view of the accompanying drawings which are made a part of this specification.

BRIEF DESCRIPTION OF THE DRAWINGS

FIG. 5 is an elevation view partially in section and illustrates apparatus used in conducting demonstrations in accordance with the present invention;

FIG. 6 is a perspective view of a block of tar sand flooded in accordance with the present invention showing position of core samples taken after the flood;

FIG. 7 is a table illustrating the analysis of such cores; and

DETAILED DESCRIPTION OF THE EMBODIMENTS OF THE INVENTION

Figure 1:
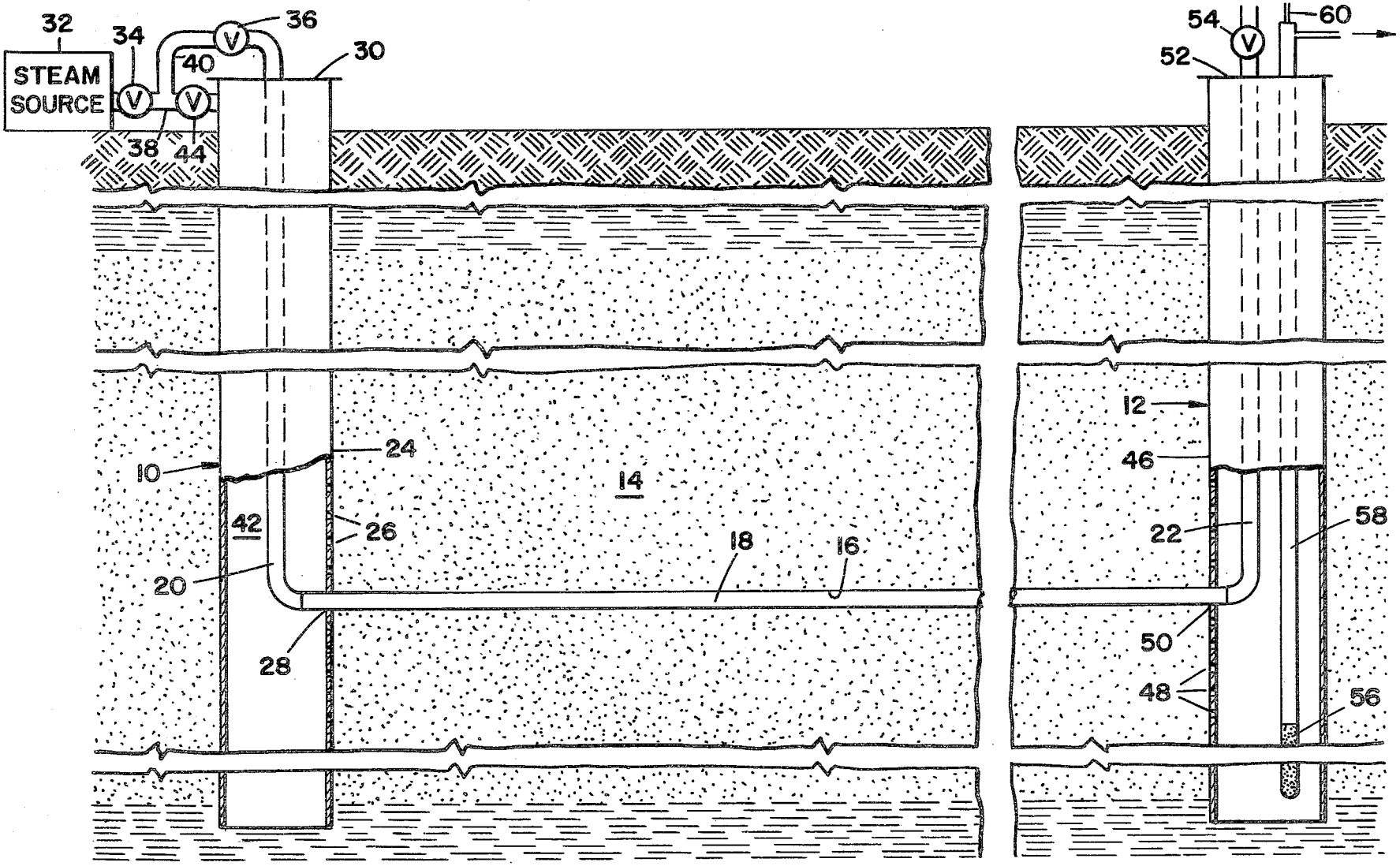
FIG. 1 is an elevation view partially in section and illustrates the preferred embodiment of apparatus assembled in accordance with the present invention for use in recovering viscous petroleum from an underground formation.

Refer now to the drawings, and to FIG. 1 in particular, where the preferred embodiment of apparatus assembled in accordance with the invention is illustrated. FIG. 1 shows a pair of spaced-apart wells or shafts, indicated generally by the numerals 10 and 12, which penetrate the earth to a viscous petroleum or tar sand formation 14. For ease in description, well 10 will be termed an injector shaft 10 and well 12 will be termed a producer shaft 12. A hole 16 is formed between the injector shaft 10 and the producer shaft 12 and a solid-wall, hollow tubular member 18 is inserted through the hole 16. The tubular member is preferably steel and may be made up of one piece or many connecting joints. A tubing string 20 is connected in a fluid-tight manner to the tubular member 18 in the injection shaft 10 and extends to the surface. In a like manner, tubing string 22 is connected to the other end of the tubular member 18 in the producer shaft 12 and extends to the surface. The solid-wall, tubular member 18 provides a continuous, uninterrupted flow path through the viscous petroleum-containing formation. Tubing strings 20 and 22 serve to extend this flow path to the surface through the injection shaft and the recovery shaft.

The injection shaft 10 is cased by casing string 24. The casing is perforated or slotted, as indicated by the numeral 26. An opening 28 for the tubular member 18 is also provided in the casing. The upper end of the casing 24 is closed by a wellhead indicated schematically as 30. A steam source 32 is connected through valves 34 and 36 and suitable tubing 38 and 40 to tubing string 20 and thence to tubular member 18. The tubing 20-casing 24-annulus 42 is also connected to steam source 32 by means of tubing 38 through valves 34 and 44. Thus, by appropriate control of valves 34, 36 and 44, steam may be directed either simultaneously or alternatively into the tubular member 18 via tubing string 20 and/or into the formation 14 via tubing-casing annulus 42 and perforations 26. Control is exercised on the heat passing through the in-place tubular member. Recoveries without the in-place tubular member were zero when the displacement mechanism was a simple conventional steam drive. This reasonably simulates conditions in much of the Athabasca deposit. Using an in-place tubular member and the method of the present invention, recoveries as high as 65% were obtained on displacing the petroleum with a steam drive at 320° F. The method of the present invention would find application in shallow heavy oil formations that are too deep for mining and too shallow for huff-and-puff recovery methods; generally these would be petroleum sands with an overburden of 300 to 600 feet.

The producer shaft 12 is cased by a suitable casing string 46. The casing is slotted or perforated, as indicated by the numeral 48. An opening 50 is provided in the casing for tubular member 18. The upper end of the casing string 46 is closed by a wellhead 52. An opening for tubing string 22 is provided in the wellhead 52 and a valve 54 is connected on the tubing string and is used for controlling flow out of tubing string 22. A means for lifting petroleum from the interior of production shaft 12 is provided. For example, a pump 56 is used to lift petroleum by a suitable sucker rod string 60 through a production flow path 58 to the surface.

In operation, it is usually desirable to first introduce steam into the annulus 42 of injection shaft 10 to attempt to obtain injection of steam into formation 14 through perforations 26. In most instances, in viscous tar sands little or no injection is obtained. In accordance with the invention, steam is then flowed through the formation 14 via tubular member 18 by appropriate manipulation of valves 34, 36, 44 and 54. The steam or hot fluid flowing in tubular member 18 heats the viscous petroleum in formation 14 to reduce the viscosity of at least a portion of the petroleum adjacent the tubular member 18. This provides a potential passage for flow of the drive fluid or steam through the formation via annulus 42 and perforations 26. By suitably controlling the flow in the tubular member 18 and the formation 14, a good sweep efficiency can be obtained and oil recovery maximized. Thus, when the steam flowing in tubular member 18 establishes injectivity for the drive fluid into the formation and results in some production of petroleum from the producer steam flow through the tubular member is terminated to prevent breakthrough of the drive fluid. If injectivity of the drive fluid becomes undesirably low then additional steam is flowed through the tubular member to reestablish the desired injectivity.

Figure 2:
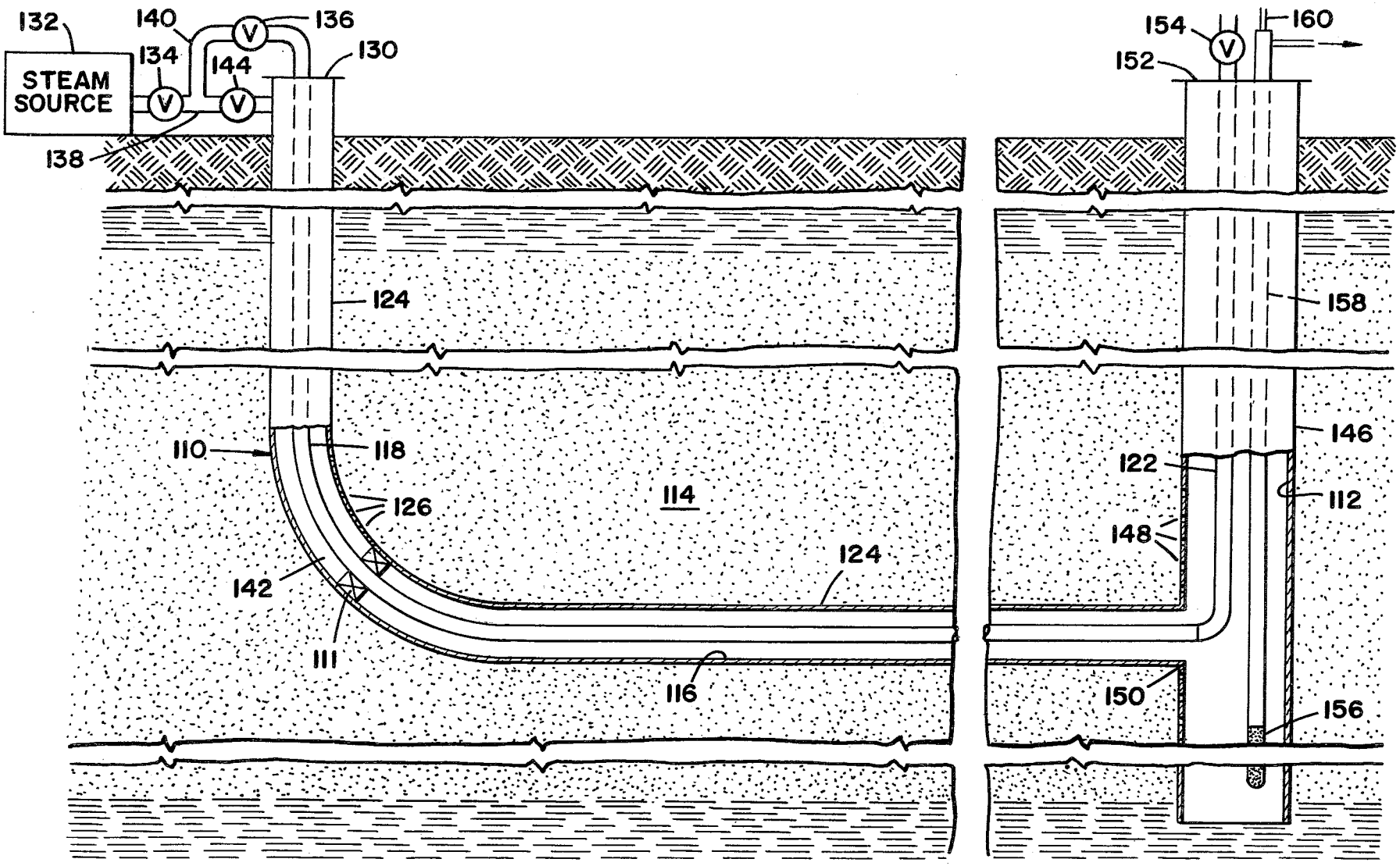
FIG. 2 is an elevation view partially in section and illustrates an alternative arrangement of apparatus assembled in accordance with the present invention.

FIG. 2 is an elevation view partially in section and illustrates an alternative arrangement of apparatus assembled in accordance with the present invention. FIG. 2 shows a producer shaft 112 penetrating the earth through a viscous petroleum or tar sand formation 114. The producer shaft 112 is cased by a suitable casing string 146. The casing 146 is slotted or perforated as indicated by the numeral 148. An opening 150 is provided in the casing to receive a casing 126 of a directionally drilled well as described below. The upper end of producer casing string 146 is closed by a wellhead 152. A means for lifting petroleum from the interior of producer shaft 112 is provided. For example, a pump 156 is used to lift petroleum by a suitable sucker rod string 160 through a production flow path 158 to the surface.

In this embodiment of the invention, a slanted or directionally drilled injector well 110 has been drilled from the earth's surface to intercept producer shaft 112. The casing 124 of a substantially horizontal portion 116 of well 110 is connected into the opening 150 of the casing 146 of the producer shaft 112. The upper end of the injector well 110 is closed by a wellhead 130 connected on casing string 124. A solid-wall, hollow tubular member 118 extends through wellhead 130 and casing string 124 to producer shaft 112. A tubing string 122 is connected to tubular member 118 and extends through wellhead 152 and valve 154 to the surface to provide a continuous, uninterrupted flow path through the viscous petroleum-containing formation 114. A packer 111 packs off the annular space 142 between tubular member 118 and casing string 124. Communication between annulus 142 and the petroleum formation 114 is provided by perforations 126.

A steam source 132 is connected through valves 134 and 136 by suitable tubing 138 and 140 to tubular member 118. The tubular member 118-casing 124 annulus 142 is also connected to the steam source 132 by means of tubing 138 through valves 134 and 144. Thus, by appropriate control of valves 134, 136, 144 and 154, steam may be directed either simultaneously or alternatively into the tubular member 118 and/or into the formation 114 via tubing casing annulus 142 and perforations 126 to carry out the method of the present invention.

Figure 3:
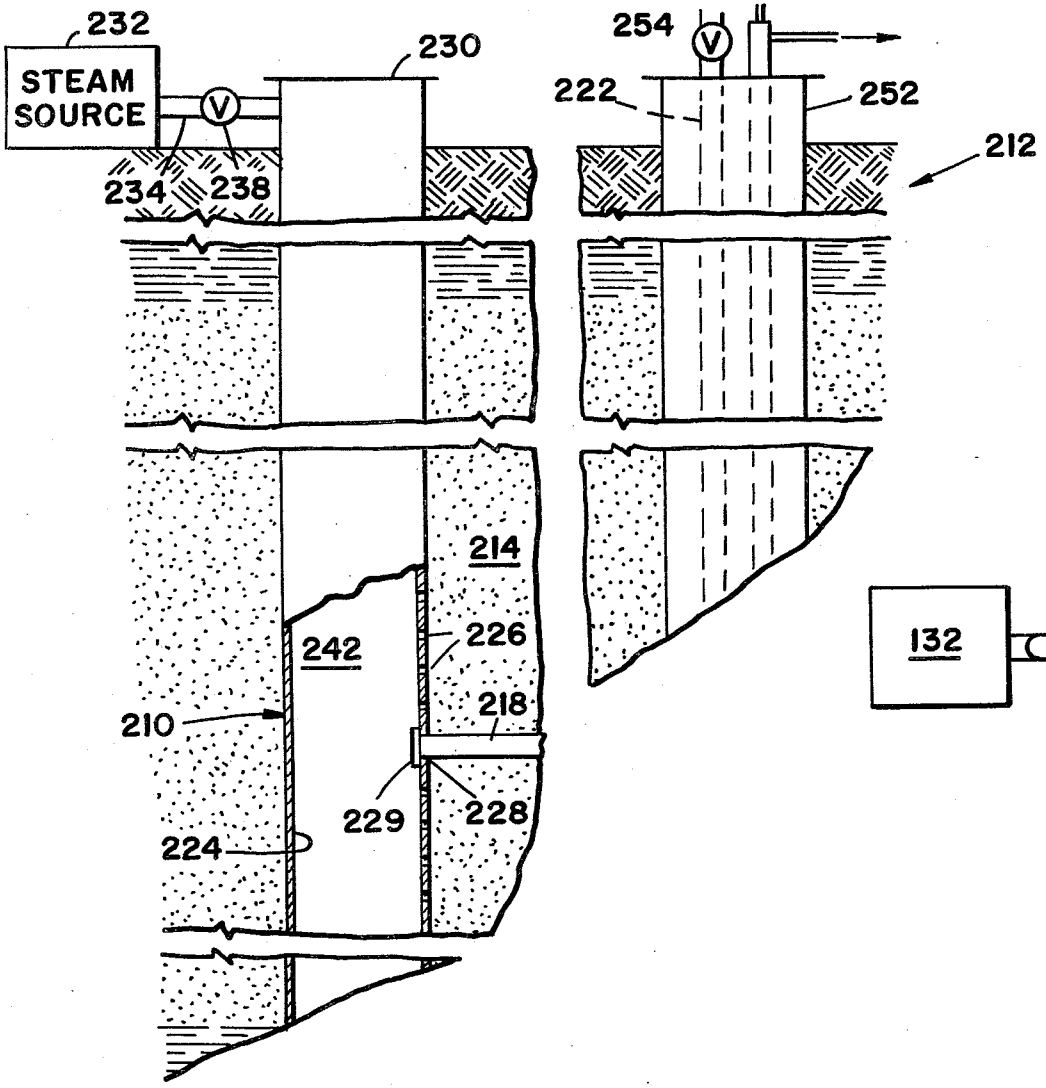
FIG. 3 is an elevation view partially in section and illustrates another alternative arrangement of apparatus assembled in accordance with the present invention.

FIG. 3 illustrates an embodiment of the invention where the control of the ratio of hot fluid and the drive fluid entering the tubular member 218 and the formation 214 is controlled by a down-stream valve 254 located on tubing string 222 which extends out of wellhead 252. Tubing string 222 is connected to the tubular member 218 to provide a flow path for steam through the petroleum-containing formation 214 to the surface. In this embodiment, the solid-wall tubular member 218 extends between an injector well 210 and a producer well 212 through petroleum-containing formation 214. Tubular member 218 is connected to casing string 224 at opening 228 by suitable means such as flange 229. The tubular member 218 is open for flow through flange 229. The annulus 242 of well 210 also communicates with formation 214 through perforations 226. A steam source 232 is connected through wellhead 230 to annulus 242 by means of tubing 238 and valve 234. The ratio of the steam flow through annulus 242 into the tubular member 218 or the perforations 226 is controlled by means of down-stream valve 254. In this manner a desirable balance between heat transfer through tubular member 218 to the formation adjacent the tubular member and steam sweep efficiency in formation 214 can be obtained.

Figure 4:
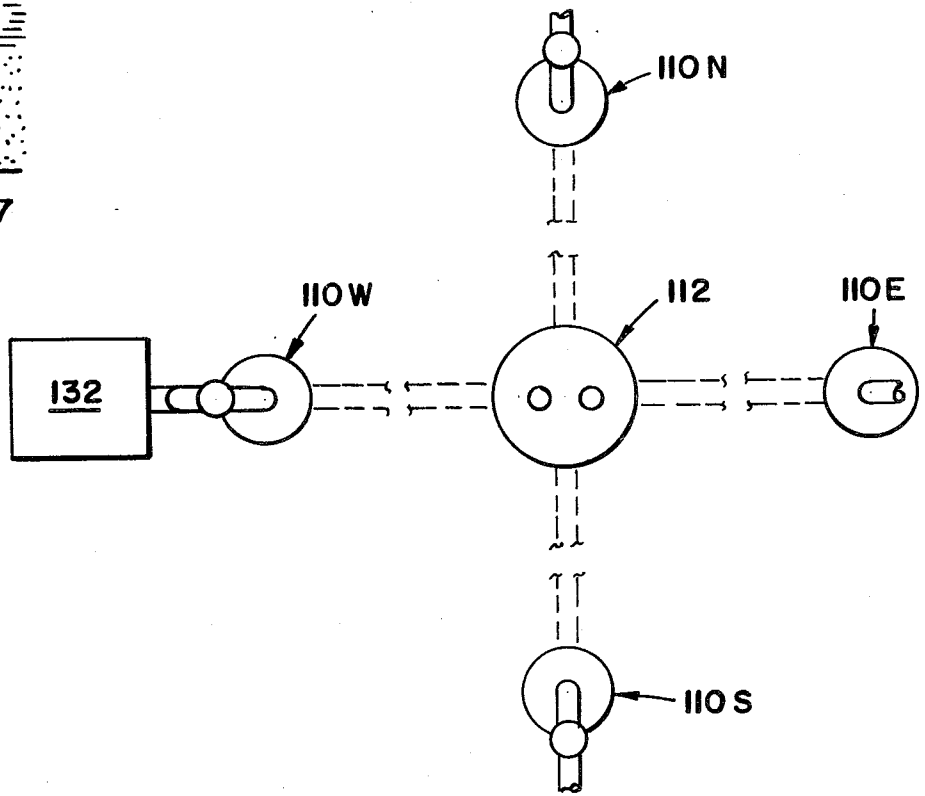
FIG. 4 is a plan view and illustrates a potential well layout in accordance with the present invention.

FIG. 4 is a plan view of a potential field layout using a central producer shaft and a plurality of spaced-apart injector wells. The plan view of FIG. 4 could, for example, be utilized with the well arrangement shown in elevation in FIG. 2. Thus a central producer well indicated generally by 112 is seen intermediate of spaced-apart injector wells indicated generally by the numerals 110E (east), 110N (north), 110W (west) and 110S (south). The arrangement illustrated in FIG. 4 provides a useful layout in field operations.

FIG. 5 is an elevation view partially in section and illustrates apparatus used in conducting demonstrations in accordance with the present invention. As there shown, a sand pack 70 of Athabasca tar sand was encased in a suitable elongated core tube 72. The core tube was provided with suitable end plates 74 and 76 for receiving a hollow tubular member 78. The apparatus is also arranged for steam injection into the face of the sand pack through conduit 80 and for collecting proceeds of the sand pack flood through conduit 82. A steam source 84 is connected to the tubular member 78 and to the sand pack face through tubing 86 and control valve 88. A down-stream control valve 90 controls flow of steam through the central tubular member 78. Thus, assisted recovery operations in accordance with the invention can be demonstrated utilizing the apparatus shown in FIG. 5.

FIG. 6 is a perspective of a block of Athabasca tar sand showing a number of core positions for cores taken longitudinally through the core block. The cores are identified by number and flow plane as indicated. The tar sand block was flooded in accordance with the method of the invention. The cores were taken after the flood and analyzed for residual petroleum. FIG. 7 is a table indicating the residual viscous petroleum weight by core position and plane of the cores of FIG. 6. The original block contained 13.5% by weight of viscous petroleum. As is evident from the table of FIG. 7, a substantial weight percent of a viscous petroleum was recovered when the block was flooded in accordance with the method of the present invention.

Further with respect to FIGS. 5, 6 and 7, in order to demonstrate the method of the present invention, it was necessary as a first step to set up an apparatus containing Athabasca oil sand having a zero effective permeability to steam. To do this, a 1 inch-ID by 12 inches-long quartz tube was used. The tube was packed with Athabasca oil sand containing about 13% weight viscous petroleum and about 4% water. Fittings were attached to both ends of the tube and a conventional steam drive applied to the oil sand at a pressure of 75 psi and a temperature of 320° F. It was found during the early runs that 50% of the petroleum was recovered because of unrealistic permeability to steam, and so the runs did not successfully simulate Athabasca conditions. It was found later that by using a ½ inch-diameter solid steel rod, 12 inches long, as a tool for rammmming the oil sand very tightly in the tube, the room temperature air permeabilities were reduced to less than 50 millidarcies, a much more realistic value for viscous petroleum-containing formations. In this region of permeability, conventional steam drive did not work and the steam front advanced only about 1 inch into the tube and no farther, since the initially immobilized petroleum blocked off any communication, thereby reducing the effective mobility to zero. These conditions were reproducible on a satisfactory basis.

The method of the invention was then demonstrated using the apparatus shown schematically in FIG. 5. FIG. 5 shows a partially completed demonstration in accordance with the method of the invention. The in-place tubular member 78 has been heated by opening the heated annulus control valve 90 allowing steam to pass through. This immediately provides steam injectivity at the drive end of the tar sand pack 70 and viscous petroleum produced immediately at the producing end. Recoveries in these experiments ranged from 48 to 52% weight of the total petroleum in place. Residual petroleum was determined in every case by exhaustive solvent extraction at the end of each run. In some demonstrations, too much heat was allowed to pass through the tubular member 78, thereby creating an annulus outside the tubular member of very high mobility, allowing premature steam breakthrough and giving rather poorer recoveries, on the order of only 30% of the total petroleum in place.

In order to demonstrate the present method in a laboratory under more realistic field-type conditions, the demonstrations were modified by using large chunks of relatively undistributed Athabasca oil sand. These ranged in weight from 1 to about 4 kilograms and appeared to be devoid of cracks. They were randomly shaped and generally roundish or oval. These were encased in epoxy resin so that a total thickness of about 4 inches existed all around the oil sand piece. The placement of the in-place tubular member and injector and producer were very similar to the apparatus shown in FIG. 5. Again, a ⅛ inch stainless-steel tube was used for the in-place tubular member. In order to establish that there was indeed zero effective mobility, a steam drive was always applied to the injector before allowing any heat to pass through the in-place tubular member. Three experiments were run, and in no case was there more than four drops of water produced at the exit from the block, and this slight water production ceased after less than 1 minute after initiating conventional steam drive. After reaching this static condition with zero injectivity, the heated annulus control valve 90 was cracked slightly, allowing passing of steam into the tubular member 78. Immediately petroleum flowed from the producer end of the core at a high petroleum/water ratio. Care must be exercised in controlling the amount of heat through the in-place tubular member since, in one case, this was not done and the over-all recovery was 30% of the total petroleum in place. Even continued flowing of steam through the block between injector and producer did not allow any further recovery of petroleum in this instance. On breaking open the block, it was found that a very clean oil sand of higher permeability had been created as an annulus close to the in-place pipe. Since the heat in the tubular member was not controlled, good sweep efficiency of the block was not obtained in this case.

The most successful demonstration run was that carried out on a 3.5-kg block of oil sand, initially 13.5% weight petroleum content. Total recovery was 65% of the petroleum originally in place. In all of these experiments, the same pressure and temperature of 75 psi and 320° F respectively were used.

Although, at first glance, the practice of the invention might lead one to expect a very low residual oil content close to the annulus surrounding the in-place tubular member and a high residual oil resulting from poor sweep efficiency in those regions of the sample farthest away from the in-place pipe, this was not the case. In fact, excellent sweep efficiency is obtained when the ratio of hot fluid to drive fluid is controlled so as not to permit early steam breakthrough. In order to evaluate this concern, the encased 3.5-kg block of oil sand at the end of a demonstration was cut through the center at right angles to the in-place tubular member. The oil sand was then cored using a ¾ inch-diameter core borer and sampled to a depth of ½ inch. This was done at 11 locations in each of six different planes in the oil sand block. A diagram of the location of these core samples is shown in FIG. 6. A total of 66 samples was taken and each analyzed for residual petroleum content by exhaustive extraction with toluene. The results are shown in FIG. 7. It can be seen that a remarkably uniform sweep of the oil sand sample had taken place. Particularly surprising is the fact that the residual petroleum in those six cores taken from the annulus immediately surrounding the in-place tubular member show a residual petroleum content not too different from the cores farthest away from the in-place tubular member.

The demonstrations show that the method of the present invention satisfactorily simulated the zero effective mobility of the Athabasca oil sand deposit. The recovery demonstrations showed that a communication path between injector and producer can be successfully developed; and provided excessive heating of the in-place tubular member is avoided, recoveries up to 65% of the petroleum in place can be achieved. The sweep efficiency is surprisingly high, resulting in an even distribution of residual oil. This means that the reservoir after an assisted-recovery operation conducted in accordance with the invention would be amendable to further recovery techniques such as combustion, chemical floods, etc. Particularly attractive is the fact that injecting drive fluids would be confined to the area of interest between injector and producer, since this would be the only pathway open to them. In other words, it is unlikely that the fluids would be lost to the other parts of the reservoir because of the relative impermeability of the formation on the outer edge of the swept area.

Figure 8:
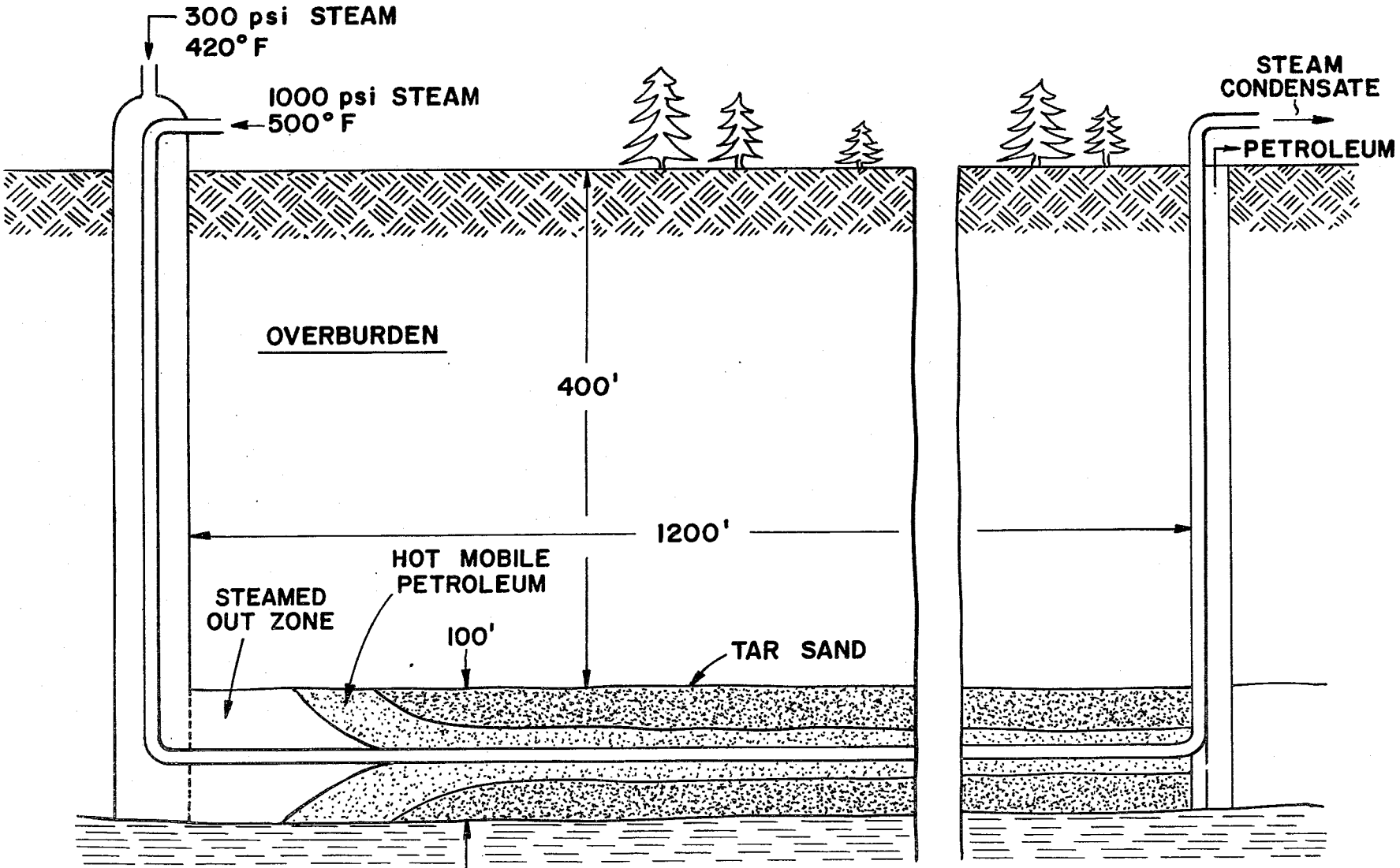
FIG. 8 is a schematic elevation partially in section and illustrates how the present invention could be applied on a field scale to a viscous petroleum-containing formation such as an Athabasca tar sand.

FIG. 8 is a schematic elevation view partially in section and illustrates how the present invention could be applied to a field scale to a viscous petroleum-containing formation such as an Athabasca tar sand. The dimensions shown in FIG. 8 and the steam temperatures and pressures, of course, will depend to some extent on the nature of the particular deposit.

Several embodiments of the present invention have been described in detail. The invention, however, is not limited to any of these specific embodiments but is meant to include all modifications coming within the terms of the claims.

What is claimed is:

1. A method of assisting the recovery of viscous petroleum from a petroleum-containing formation comprising forming a hole through a petroleum-containing formation; forming a flow path in said hole isolated from said formation for flow of fluid through said formation into and out of said hole; flowing a hot fluid through said flow path out of contact with said formation to heat viscous petroleum in said formation outside said flow path to reduce the viscosity of at least a portion of the petroleum adjacent the outside of said flow path to provide a potential passage for fluid flow through said formation adjacent the outside of said flow path and injecting a drive fluid into said formation through said passage adjacent the outside of said flow path to promote movement of the petroleum through said passage adjacent the outside of said flow path to a recovery position for recovery from said formation.

2. A method of assisting the recovery of viscous petroleum from a petroleum-containing formation comprising forming a hole through a petroleum-containing formation; inserting a solid-wall, hollow tubular member into said hole to provide a continuous, uninterrupted flow path through said formation; flowing a hot fluid through the interior of said tubular member out of contact with said formation to heat viscous petroleum in said formation outside said tubular member to reduce the viscosity of at least a portion of the petroleum adjacent the outside of said tubular member to provide a potential passage for fluid flow through said formation adjacent the outside of said tubular member and injecting a drive fluid into said formation through said passage adjacent the outside of said tubular member to promote movement of the petroleum through said passage adjacent the outside of said tubular member to a recovery position for recovery from said formation.

3. The method of claim 2 wherein said hot fluid is steam.

4. The method of claim 3 wherein the drive fluid is steam.

5. The method of claim 2 wherein said hot fluid and said drive fluid are injected simultaneously.

6. The method of claim 2 wherein said hot fluid and said drive fluid are injected intermittently.

7. The method of claim 2 where injectivity of said drive fluid into said formation is controlled by adjusting the flow of hot fluid through said tubular member.

8. A method of assisting the recovery of viscous petroleum from a tar sand formation of an Athabasca type, comprising providing an injection shaft and a recovery shaft extending from the earth's surface through a tar sand formation; forming a hole through said tar sand formation between said injection shaft and said recovery shaft; inserting a solid-wall, hollow tubular member into said hole to provide a continuous, uninterrupted flow path from said injection shaft to said recovery shaft through said tar sand formation; flowing a hot fluid through the interior of said tubular member out of contact with said tar sand formation to heat viscous petroleum in said tar sand formation between said injection shaft and said recovery shaft outside said tubular member to reduce the viscosity of at least a portion of the petroleum adjacent the outside of said tubular member to provide a potential passage for fluid flow through said tar sand formation adjacent the outside of said tubular member, injecting a drive fluid from said injection shaft into said passage to promote flow of petroleum toward said recovery shaft and recovering petroleum from said recovery shaft.

9. The method of claim 8 wherein said hot fluid is steam.

10. The method of claim 9 wherein said drive fluid is steam.

11. The method of claim 8 wherein said hot fluid and said drive fluid are injected simultaneously.

12. The method of claim 8 wherein said hot fluid and said drive fluid are injected intermittently.

13. The method of claim 8 where injectivity of said drive fluid into said formation is controlled.

14. A method of assisting the recovery of viscous petroleum from a petroleum-containing formation comprising forming a hole through a petroleum-containing formation; inserting a solid-wall, hollow tubular member into said hole to provide a continuous, uninterrupted flow path through said formation; flowing steam through the interior of said tubular member out of contact with said formation to heat viscous petroleum in said formation outside said tubular member to reduce the viscosity of at least a portion of the petroleum adjacent the outside of said tubular member to provide a potential passage for fluid flow through said formation adjacent the outside of said tubular member and injecting steam into said formation through said passage adjacent the outside of said tubular member to promote movement of the petroleum through said passage adjacent the outside of said tubular member to a recovery position for recovery from said formation.

* * * * *